US006806631B2

(12) United States Patent
Yoshii et al.

(10) Patent No.: US 6,806,631 B2
(45) Date of Patent: Oct. 19, 2004

(54) COLOR CRT MASK FRAME, A STEEL SHEET USED THEREFOR AND A MANUFACTURING METHOD FOR THE STEEL SHEET, AND A COLOR CRT EQUIPPED WITH THE FRAME

(75) Inventors: Tatsuo Yoshii, Wakayama (JP); Noriaki Nagao, Himeji (JP); Shinji Tsuge, Nishinomiya (JP); Hideharu Ohmae, Toyonaka (JP)

(73) Assignees: Sumitomo Metal Industries, Ltd., Osaka (JP); Matsushita Electric Industrial Co., Ltd., Kadoma (JP)

( * ) Notice: Subject to any disclaimer, the term of this patent is extended or adjusted under 35 U.S.C. 154(b) by 0 days.

(21) Appl. No.: 10/682,407

(22) Filed: Oct. 10, 2003

(65) Prior Publication Data

US 2004/0095052 A1 May 20, 2004

Related U.S. Application Data

(62) Division of application No. 09/985,131, filed on Nov. 1, 2001, now Pat. No. 6,699,334, which is a continuation of application No. PCT/JP01/01602, filed on Mar. 2, 2001.

(30) Foreign Application Priority Data

Mar. 2, 2000 (JP) ..... 2000-57551

(51) Int. Cl.[7] ..... H01J 29/80

(52) U.S. Cl. ..... 313/402; 313/405

(58) Field of Search ..... 313/402, 405

(56) References Cited

FOREIGN PATENT DOCUMENTS

| | | |
|---|---|---|
| JP | 08-067945 | 3/1996 |
| JP | 08-176728 | 7/1996 |
| JP | 410226821 A | 8/1998 |

*Primary Examiner*—Vip Patel
(74) *Attorney, Agent, or Firm*—Burns, Doane, Swecker & Mathis, L.L.P.

(57) ABSTRACT

This invention provides a mask frame for a color CRT made from a steel composition consisting essentially of, in mass %, C: 0.03–0.30%, Si: at most 0.30%, Mn: 0.05–1.5%, P: at most 0.05%, S: at most 0.02%, Mo: 0.02–0.50%, V: 0.02–0.20%, Al: at most 0.10%, N: 0.0040–0.0200%, Cu: at most 1.0%, Ni: at most 1.0%, Cr: at most 2.0%, W: at most 1.0%, B: at most 0.003%, Ti: at most 0.030%, and Nb: at most 0.030%, and a balance of iron and unavoidable impurities, with Al≦(7.0)N, and having a metal structure in which the ferrite grain size is at most 15 micrometers and the ferrite volume ratio is at most 90%.

8 Claims, 2 Drawing Sheets

COLOR CRT MASK FRAME, A STEEL SHEET USED THEREFOR AND A MANUFACTURING METHOD FOR THE STEEL SHEET, AND A COLOR CRT EQUIPPED WITH THE FRAME

This application is a divisional application of application Ser. No. 09/985,131, filed Nov. 1, 2001 now U.S. Pat. No. 6,699,334 which is a continuation of International Application No. PCT/JP01/01602, filed on Mar. 2, 2001, which International Application was published by the International Bureau in Japanese on Sep. 7, 2001.

TECHNICAL FIELD

This invention belongs to the technical field of color CRT's (color cathode ray tubes) (also referred to as color picture tubes) used in television receivers, displays, and the like. More specifically, this invention relates to a mask frame, a steel sheet used in manufacturing the mask frame and a manufacturing method therefor. The mask frame is a member which supports under tension a tension-type shadow mask which is disposed within a color CRT (in this specification referred to as a color CRT mask frame).

BACKGROUND ART

A color CRT has in its interior three electron guns for red, blue, and green and a fluorescent screen (screen) impacted by electron beams discharged therefrom. The surface of the fluorescent screen has fluorescent dots formed thereon which generate the above-mentioned three colors and which are arranged in a regular sequence.

In the type of shadow mask type used in the majority of color CRT's, a rectangular shadow mask having a large number of aligned beam passage holes is disposed just in front of the fluorescent screen. The shadow mask is a member for performing alignment of the electron beams and the fluorescent dots so that each electron beam irradiates the fluorescent dots of the corresponding color.

A conventional ordinary shadow mask is made of a cold rolled steel sheet having a thickness of 0.15–0.28 mm in which fine holes with a regular spacing are formed by etching. After the shadow mask is bent by press forming, its four sides are welded to a mask frame and secured. The curvature of the mask is necessary so that thermal expansion of the mask and vibrations transmitted from the outside are absorbed by the mask and positional deviation of the holes in the mask does not take place. Accordingly, this type of mask can not adequately cope with flattening of the mask surface.

A more recently developed type is a tension-type shadow mask. A typical tension-type shadow mask is made of a thin steel sheet having a thickness of 0.05–0.15 mm in which small holes for the passage of beams are formed. It is attached to a mask frame in a state in which a tensile force is applied to it in the vertical direction. Thermal expansion and vibration of the mask can be absorbed by the tension, and the mask can be made flat. A tension-type shadow mask in which bi-directional tension is applied in both the vertical direction and the horizontal direction is also possible.

A mask frame for supporting the above-described typical tension-type shadow mask is normally assembled by welding two long-side frame members extending in the horizontal direction which form upper and lower frame portions and two short-side frame members extending in the vertical direction which form left and right frame portions. The long-side frame members are made from a steel sheet shaped by press forming or roll forming of the steel sheet. The thickness of the steel sheet is in the range of 3–6 mm, and it is selected in accordance with the size of the CRT. Round or rectangular pipes or bars are normally used as the short-side frame members.

Before attaching the shadow mask to the mask frame, blackening treatment of the mask frame is carried out. The blackening treatment is treatment in which a black film made of $Fe_3O_4$ is formed on the surface of the steel by heat treatment. The black film increases the thermal emissivity of the surface of the material, it increases the absorption and irradiation of electron beams, and it also has the effect of preventing the generation of secondary electrons and the formation of rust. The heating conditions for this blackening treatment are normally 450–680° C. for 10–30 minutes.

Attaching the above-described tension-type shadow mask to a mask frame is carried out by welding the upper and lower edges of the shadow mask to the upper frame portion and the lower frame portion of the frame while compressing from the outside towards the inside the upper frame portion and the lower frame portion of the mask frame formed from the long-side frame members, and if necessary simultaneously applying tension to the shadow mask in the vertical direction. Then, when the pressure applied to the upper frame portion and the lower frame portion of the frame is removed, due to the rebound force of the frame, the shadow mask is supported by the frame in a state in which it is pulled in the vertical direction. The left and right edges of the shadow mask are not secured to the left and right frame portions of the mask frame (made from the short-side frame members).

In a structure in which a shadow mask is attached to a mask frame (also referred to below as a shadow mask/frame structure) in this manner, the upper frame portion and the lower frame portion of the mask frame are in a state in which a bending stress is applied, and the shadow mask is in a state in which it receives a tensile force in the vertical direction. The left and right frame portions of the mask frame perform the function of supporting the upper and lower frame portions which are under a bending stress.

Finally, stress relief annealing is applied to the shadow mask/frame structure, and strains occurring at the time of mask installation are removed. The stress relief annealing is generally carried out by heating at a temperature of 400–680° C. for 10–30 minutes.

The order of steps of the above-described process (referred to below as Process A) is as follows:

Forming mask frame members-->assembly of mask frame-->blackening treatment of mask frame-->mounting of shadow mask on frame-->stress relief annealing In the above order of steps, the step of blackening treatment and the step of stress relief annealing can be reversed. In this case, in the step of stress relief annealing, strains in the mask frame due to forming and welding are removed. In the step of blackening treatment, the mask frame and the shadow mask together undergo blackening treatment, and the strains resulting from installation of the shadow mask are also removed during the blackening treatment. The order of steps in this process (referred to below as Process B) is as follows:

Forming-->assembly-->stress relief annealing-->installation of shadow mask-->blackening treatment In either of these processes, in the step of blackening treatment, it is desired to form a black film having good adhesion. If the adhesion of the black film is poor, there are cases in which the black film peels off during use of a color CRT, pieces of the black film fall down inside the CRT, the beam passage holes in the shadow mask are plugged and the like, and as a result, the image receiving properties of the CRT are greatly damaged.

The heat treatment step which is carried out after installation of the shadow mask (stress relief annealing in the case of Process A and blackening treatment in the case of Process B) is heat treatment carried out under the special circumstances in which the upper and lower frame portions of the mask frame are subjected to a bending stress and the shadow mask receives tension. When the bending stresses in the upper and lower frame portions of the mask frame are greatly alleviated by this heat treatment, there is the possibility of deformation of the mask frame taking place. A tensile force in the vertical direction is applied to the shadow mask by the mask frame, so deformation of the upper and lower frame portions of the mask frame causes a reduction in the tensile force acting on the shadow mask and causes surface strains. As a result, wrinkles and non-uniformity of the pitch of the holes develop, and are cases in which a deterioration of properties occurs such as impurity of color. Accordingly, it is important to suppress deformation of the mask frame during heat treatment.

In order to decrease the deformation of the mask frame during the above-described heat treatment step, which is a cause of a decrease in tensile force and surface strains of a tension-type shadow mask, the long-side frame members which make up the upper and lower frame portions of the mask frame which supports the shadow mask under tension have been manufactured from 36 Ni steel or 42 Ni steel having a high level of high-temperature creep strength. These steels respectively include 36% or 42% of Ni, which is expensive, so the mask frame becomes expensive.

Recently, televisions are tending to become large in size, and mask frames are also becoming large. In order to achieve decreases in the weight of televisions, there is a demand to increase the strength and decrease the thickness of steel which is used as a material for hanging mask frames.

DISCLOSURE OF THE INVENTION

An object of the present invention is to provide a steel sheet for a color CRT mask frame which is relatively inexpensive, which has excellent high-temperature strength, and which has a small amount of creep at high temperatures. As a result, deformation of a frame during heat treatment such as stress relief annealing carried out after mounting of a tension-type shadow mask on a mask frame can be suppressed to a minimum value, and the occurrence of wrinkles in a shadow mask and the occurrence of irregularities in the pitch of holes due to heat treatment can be prevented.

Another object of this invention is to provide a steel sheet for a color CRT mask frame which has a high strength so that the mask frame can be reduced in weight and which has adequate formability and on which a black film having good adhesion can be formed by blackening treatment.

Another object of this invention is to provide a method of manufacturing the above-described steel sheet for a color CRT mask frame.

The present invention is based on the below-described knowledge found by the present inventors.

(1) There is generally a tendency for deformation of a mask frame during heat treatment carried out under loading of a bending stress to be suppressed by using steel with a high level of high-temperature yield strength. However, even for steel materials having the same level of high-temperature yield strength, there is a considerable difference in the amount of deformation.

(2) With respect to deformation of the above-described mask frame, the degree of resistance to deformation of the steel can be determined by measuring the amount of creep occurring during one hour under conditions of a stress of at least 196 $N/mm^2$ and a temperature of at least 400° C.

(3) A steel sheet to which V and N are added in addition to Mo, which has the effect of improving high-temperature strength, and in which the ferrite grain size and the ferrite volume ratio are controlled to be at most prescribed values has a low value of creep under the above-described conditions even without containing a large amount of expensive Ni.

According to one aspect, the present invention is a steel sheet for a color CRT mask frame having a steel composition consisting essentially of, in mass %, C: 0.03–0.30%, Si: at most 0.30%, Mn: 0.05–1.5%,
P: at most 0.05%, 5: at most 0.02%, Mo: 0.02–0.50%,
V: 0.02–0.20%, Al: at most 0.10%, N: 0.0040–0.0200%, PS optionally one or two or more of Cu: at most 1.0%, Ni: at most 1.0%, Cr: at most 2.0%, W: at most 1.0%, B: at most 0.003%, Ti: at most 0.030%, and Nb: at most 0.030%, and a balance of iron and unavoidable impurities, with Al≦(7.0)N, and having a metal structure in which the ferrite grain size is at most 15 micrometers and the ferrite volume ratio is at most 90%.

From another aspect, the present invention is a rectangular mask frame for a color CRT formed by joining four frame members, wherein at least a portion of the frame members is formed of the above-described steel sheets.

This invention also relates to a color CRT equipped with this mask frame.

According to another aspect, the present invention is a method of manufacturing a steel sheet for a color CRT mask frame including the following steps:

a step of manufacturing a slab having a steel composition consisting essentially of, in mass %, C: 0.03–0.30%, Si: at most 0.30%, Mn: 0.05–1.5%,
P: at most 0.05%, S: at most 0.02%, Mo: 0.02–0.50%,
V: 0.02–0.20%, Al: at most 0.10%, N: 0.0040–0.0200%,
optionally one or two or more of Cu: at most 1.0%, Ni: at most 1.0%, Cr: at most 2.0%, W: at most 1.0%, B: at most 0.003%, Ti: at most 0.030%, and Nb: at most 0.030%,
and a balance of iron and unavoidable impurities, with Al<(7.0)N, and a step of hot rolling the slab under conditions of a finishing temperature of 820–950° C. and a coiling temperature of 400–700° C. to form a hot rolled steel sheet.

The above-described method may further include a step of carrying out cold rolling with a reduction of 0.2–15% of the hot rolled steel sheet obtained in the hot rolling step. In this case, it may further include a step of carrying out softening annealing of the hot rolled steel sheet at an annealing temperature of 600–750° C. with a soaking time at the annealing temperature of 1–25 hours prior to the cold rolling step.

The present invention also provides a color CRT mask frame manufactured by a method including the following steps:

a step of shaping the above-described steel sheet to form a color CRT mask frame member, a step of joining four mask frame members, at least a portion of which are the above-described mask frame member, to form a color CRT mask frame, and a step of performing blackening treatment of the color CRT mask frame at a temperature in the range of 450–680° C. to form a black film or a step of performing stress relief annealing of the mask frame at a temperature in the range of 400–680° C.

The present invention also provides a tension-type color CRT shadow mask/frame structure manufactured from the above-described color CRT mask frame by a method including the following steps:

a step of securing a shadow mask to the above-described color CRT mask frame so that tension is applied to the mask to form a shadow mask/frame structure, and a step of performing stress relief annealing of the structure at a temperature in the range of 400–680° C. or a step of performing blackening treatment of the structure at a temperature in the range of 450–680° C. to form a black film.

A steel sheet according to the present invention has excellent mechanical strength, but the room temperature and high-temperature mechanical strength and creep properties are further improved by precipitation of dissolved metal elements by the first heat treatment which is undergone (blackening treatment in Process A). For this reason, a mask frame which is manufactured from the steel sheet does not readily undergo deformation during heat treatment (stress relief annealing in Process A) which is carried out under the application of a bending stress after mounting of the shadow mask. Therefore, a decrease in tension of the shadow mask caused by this deformation can be suppressed to a minimum, and the generation of wrinkles and irregularity in the pitch of holes in the shadow mask due to the heat treatment are prevented.

In Japanese Published Unexamined Patent Application Hei 8-67945 (1996), a steel sheet for an aperture frame which supports an aperture grille, which is a shadow mask formed from a large number of ribbons is disclosed. It is explained that steel maintains a high level of high-temperature strength after stress relief annealing. However, the high-temperature strength in that case is the yield strength, and this is achieved by the addition of Mo. There is no suggestion whatsoever of the combined addition of V and N, as in the present invention, of the effect of ferrite structure, and of high-temperature creep properties.

A steel sheet according to the present invention is excellent not only with respect to high-temperature yield strength, but also with respect to high-temperature creep strength, and it exhibits low creep at high temperatures. In the following explanation, the terminology "high-temperature strength" will be used to include both high-temperature yield and high-temperature creep strength.

DETAILED DESCRIPTION OF THE INVENTION

Figure 1:
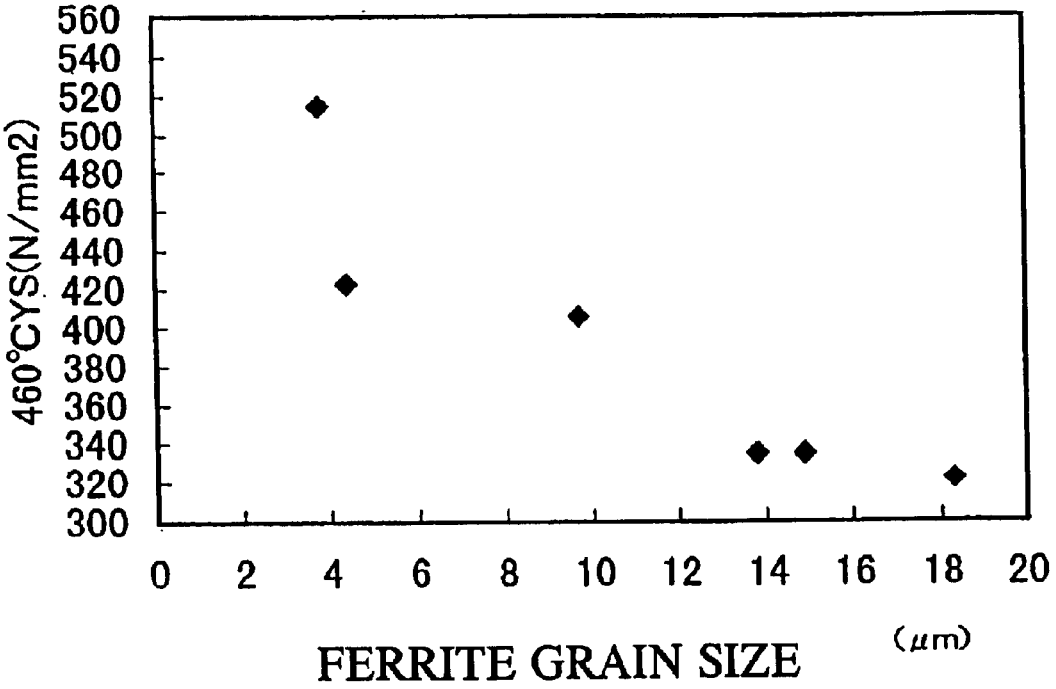
FIG. 1–FIG. 4 are respectively graphs showing the results of examples.

Below, the present invention will be described in greater detail. In the following description, unless otherwise specified, % means mass percent.

A steel sheet for a color CRT mask frame according to this invention has a steel composition consisting essentially of, in mass %, C: 0.03–0.30%, Si: at most 0.30%, Mn: 0.05–1.5%, P: at most 0.05%, S: at most 0.02%, Mo: 0.02–0.50%, V: 0.02–0.20%, Al: at most 0.10%, N: 0.0040–0.0200%, optionally one or two or more of Cu: at most 1.0%, Ni: at most 1.0%, Cr: at most 2.0%, W: at most 1.0%, B: at most 0.003%, Ti: at most 0.030%, and Nb: at most 0.030%, and a balance of iron and unavoidable impurities, with $Al \leqq (7.0)N$.

C is an element which is effective at increasing the strength of steel. At least 0.03% is contained in order to guarantee the strength of a mask frame. The upper limit on the C content is made 0.30% because addition of a larger amount of C worsens the formability and weldability of a steel sheet necessary for the manufacture of a mask frame. Preferably the lower limit on the C content is 0.05% and the upper limit is 0.20%.

Si is effective as a deoxidizing agent at the time of preparing molten steel, and it is also effective at increasing the strength of steel. On the other hand, Si deteriorates the surface conditions of a hot rolled steel sheet, and it also has the tendency to decrease the adhesion of a black film. For this reason, the amount of S is made at most 0.30%. Preferably, the amount of S is at most 0.25%.

Mn is an element which is necessary as a deoxidizing agent, and it is also effective at increasing the strength of steel. In addition, Mn fixes the impurity S as MnS, and it has the effect of preventing hot embrittlement. For this reason, at least 0.05% of Mn is contained. The upper limit on the Mn content is made 1.5% because addition of a larger amount of Mn worsens formability and weldability. Preferably, the lower limit on the Mn content is 0.2% and the upper limit is 1.0%.

P is an element which increases the strength of steel. However, P easily segregates, so a large P content causes the strength variation within a steel sheet to increase, and it worsens the formability and weldability of the steel sheet. Therefore, the P content is made at most 0.05% and preferably it is at most 0.03%.

If the S content is high, inclusions such as MnS become numerous, and formability is impaired. Accordingly, it is preferable for the S content to be low as possible, but up to 0.02% is allowable.

Mo is an element which is important for imparting high-temperature strength to the steel sheet of the present invention. Mo scarcely dissolves in cementite, while it dissolves in ferrite. When the steel undergoes heat treatment, during the stage when the temperature increases, Mo which is dissolved in ferrite precipitates in the form of $Mo_2C$ separately from cementite. By coherent precipitation, this $Mo_2C$ finely precipitates on new nuclei which are formed by dislocation of the ferrite matrix phase, so it is effective in increasing the high-temperature strength of steel.

In a steel sheet of the present invention, this coherent precipitation of fine $Mo_2C$ occurs during the initial heat treatment of the steel sheet (the blackening treatment in Process A, but as described below, there are cases in which separate heat treatment in the form of softening annealing is performed first), so a mask frame having improved high-temperature strength can be manufactured. As a result, at the time of heat treatment carried out after mounting of the shadow mask (stress relief annealing in Process A), the mask frame to which bending stresses are applied exhibits low creep, and it can maintain tension in the shadow mask.

In order to utilize this effect of Mo, Mo is contained in an amount of at least 0.02%. Taking into consideration that too high an Mo content reduces formability and weldability and that Mo is an expensive element, the upper limit on the Mo content is made 0.50%. Preferably, the lower limit on the Mo content is 0.30% and the upper limit is 0.40%.

In a steel composition according to the present invention, V is an element which is as important as Mo. Like Mo, V does not dissolve much in cementite, and during the temperature increase stage of the first heat treatment which is performed on the steel sheet, it undergoes coherent precipitation as plate-shaped $V_4C_3$ in the regions of ferrite dislocations. As a result, it increases the high-temperature strength of the mask frame, and it contributes to preventing deformation during stress relief annealing.

In order to obtain the above-described effect, V is contained in an amount of at least 0.02%. For the same reasons as for Mo, the upper limit on the V content is 0.20%. Preferably, the lower limit on the V content is 0.04% and the upper limit is 0.15%.

N can form carbides with V. Therefore, during the temperature increase stage of the first heat treatment which the steel sheet undergoes, V undergoes coherent precipitation as VN in addition to the above-described carbides, and it contributes to an increase in the high-temperature strength of a mask frame.

In order to obtain this effect, N is contained in an amount of at least 0.0040%. The upper limit on the N content is made 0.0200% because it becomes easy for pinhole defects to be formed in the slab surface during casting if a larger amount of N is added. Preferably, the lower limit on the N content is 0.0050%.

N is generally contained in steel as an impurity, but in the case of the type of steel of the present invention, the content of N as an impurity is normally less than 0.0040%.

Al is an element which is effective as a deoxidizing agent. It has the effect of fixing N, which is generally an impurity, as AlN. However, in the present invention, N is deliberately added in an amount of 0.0040–0.0200% in order to precipitate VN, so precipitation of AlN is undesirable. Furthermore, a large Al content makes it easy for surface defects of the steel sheet to occur, and as a result, the black film readily peels off. Furthermore, Al is more stable than VN, but if a large amount of Al is contained, at the time of slow cooling during coiling after the completion of hot rolling, N is fixed by Al, and the amount of effective solid solution N is decreased. For these reasons, the Al content is made at most 0.10%. Preferably, the Al content is at most 0.05%.

In order to obtain an increase in high-temperature strength of a mask frame by addition of N according to the present invention, it was found that it is necessary to limit the content of Al, which fixes N, depending on the N content. Specifically, if the Al content is more than 7.0 times the N content, the high-temperature strength of the steel sheet after heat treatment decreases. Accordingly, $Al \leqq (7.0)N$. Preferably, $Al \leqq (6.0)N$.

If desired, a steel sheet according to the present invention may further include 1 or 2 or more of Cu, Ni, Cr, W, B, Ti, and Nb. As a result, the high-temperature strength of the steel sheet after heat treatment and therefore of the mask frame can be further increased.

Cu forms a solid solution in steel at the completion of hot rolling, it finely precipitates during blackening treatment, and it increases the strength at room temperature and high temperatures. However, if too much is added, it damages formability and weldability, so the Cu content is made at most 1.0%.

Ni increases high-temperature strength, but addition of a large amount worsens formability and weldability. Ni is also an element which is effective at preventing hot embrittlement by Cu. Accordingly, when Cu is added, it is preferable to also add Ni, and it is suitable for the amount of Ni which is added at that time to be roughly the same as the amount of Cu. Taking into consideration that Ni is an expensive element, the Ni content is made at most 1.0%.

Cr and W increase high-temperature strength, but a high content thereof worsens formability and weldability. Therefore, Cr is made at most 2.0%, and W is made at most 1.0%.

B strengthens grain boundaries and it improves ductility, and by refining crystal grains, it has the effect of increasing high-temperature strength. However, if a large amount of B is added, by fixing N as BN, it decreases the precipitation of VN which is necessary for increasing high-temperature strength. Therefore, the upper limit on the B content is made 0.003%.

Ti and Nb form precipitates such as TiC and NbC, and due to the effect of refining crystal grains, they can increase room temperature and high-temperature strength. However, Ti and Nb both decrease the precipitation of VN which is necessary for increasing high-temperature strength, by combining with N to form nitrides. Therefore, when these elements are added, it is preferable to add a small amount thereof, so Ti and Nb are each made at most 0.030%.

A steel sheet of the present invention having the above-described steel composition has a two-phase metal structure of ferrite-pearlite, ferrite-bainite, or ferrite-martensite. A steel sheet of the present invention is characterized in that in this metal structure, the ferrite grain size is at most 15 micrometers, and the ferrite volume ratio is at most 90%.

As the ferrite grain size in the metal structure increases, there is a tendency for the strength of the steel sheet to decrease. Even if the steel composition is within the above-described range, it becomes difficult for a steel having a ferrite grain size larger than 15 micrometers to obtain the high-temperature strength desired of a mask frame. This is because the improvement in high-temperature strength based on precipitation of fine carbon-nitrides by the above-described initial heat treatment is not expected. The ferrite grain size is preferably at most 14 micrometers. The ferrite grain size can be adjusted by the hot rolling conditions, particularly the finishing temperature and the coiling temperature.

If the coiling temperature of the steel sheet becomes high or the C content of the steel composition becomes low, there are cases in which the second phase other than ferrite in the above-described two-phase composition (pearlite, bainite, martensite) decreases to less than 10 volume percent. In this manner, in a metal structure in which the second phase is scarce, even if the content of Mo, V, and N is controlled to suitable levels, it becomes difficult to obtain a desired high-temperature strength after the initial heat treatment. For this reason, the volume ratio of ferrite is made at most 90% and preferably at most 88%.

A steel sheet for a color CRT mask frame according to the present invention is manufactured by manufacturing a slab of steel having the above-described composition and then performing hot rolling of the slab with a finishing temperature of 820–950° C. and a coiling temperature of 400–700° C. This steel sheet can be used as a mask frame even in the hot rolled state, or cold rolling may be additionally performed with a reduction of 0.2–15%. As well known to those skilled in the art, cold rolling with a reduction of at most 2% is known as skin pass rolling (or temper rolling). Accordingly, this cold rolling includes skin pass rolling.

There are no particular restrictions on the manufacture of the slab or up to the finishing of the hot rolling, and it may be carried out in accordance with conventional techniques.

In order to refine crystal grains, it is fundamental that the finishing temperature for hot rolling be at least 820° C. and at most 950° C. and just above the $Ar_3$ transformation point. This finishing temperature also applies for the case in which cold rolling is carried out after hot rolling. If the finishing temperature is less than 820° C., hot rolling is carried out in the α phase region, and at greater than 950° C., hot rolling is carried out in the high-temperature γ phase region. In either case, crystal grains coarsen, and ferrite grains become large. A rough guideline for keeping the ferrite grain size at most 15 micrometers is for the finishing temperature to preferably be in the high-temperature range of 820–930° C.

If the coiling temperature is less than 400° C., the shape of the steel sheet after rolling worsens. If the coiling temperature exceeds 700° C., there are cases in which the ferrite volume ratio exceeds 90% and the ferrite particle grain size exceeds 15 micrometers. In addition, scale becomes thick, and the ability to remove scale by pickling worsens.

The finishing temperature for hot rolling and the coiling temperature can be set in the above-described range so as to obtain a metal structure with a ferrite grain size of at most 15 micrometers and a ferrite volume ratio of at most 90%. If the amounts of Mo, Nb, Cr, V, and the like which have the effect of suppressing recrystallization and ferrite transformation in a hot state become large, the limits on the finishing temperature and the coiling temperature are eased.

A hot rolled steel sheet which is obtained in this manner has adequate properties as a steel sheet for a mask frame according to the present invention even in this state. However, if light cold rolling is carried out, the improvements in room temperature and high-temperature strength due to the initial heat treatment become larger, and creep of the mask frame during stress relief annealing can be further decreased.

It is thought that the effects of this cold rolling can be derived from the introduction of dislocations. When dislocations are introduced by cold rolling, the precipitation of fine carbon-nitrides such as MoC, $V_4C_3$, VN, and Cu which occur during the initial hot rolling of the steel sheet is promoted. The effect of preventing movement of the dislocations by the precipitates is added to the effect of the fine precipitates themselves, and the room temperature and high-temperature strength of the steel sheet after hot rolling are increased.

In order to obtain these effects, the reduction during cold rolling is made at least 0.2% and preferably at least 0.3%. The upper limit on the reduction is made 15% because formability deteriorates above this level.

Prior to this cold rolling, if necessary descaling of the surface is carried out, and then softening annealing may be carried out under conditions of an annealing temperature of 600–750° C. with a soaking time of 1–25 hours. In this case, an increase in room temperature and high-temperature strength due to precipitation of the above-described fine carbon-nitrides occurs during the softening annealing. Descaling can be carried out by pickling, but other methods may also be used. Even when softening annealing is not carried out, it is preferable in general to perform descaling by pickling after the completion of rolling.

As already described, a color CRT mask frame and a shadow mask/frame structure can be manufactured from a steel sheet for a color CRT mask frame according to the present invention. Below, the order of steps of the above-described Process A will be described, but Process B may also be employed.

A steel sheet is first formed by press forming or roll forming, and a mask frame member is manufactured. It is possible to manufacture all four frame members of the mask frame from a steel sheet according to the present invention. However, the short-side frame members which form the left and right frame portions of the mask frame normally use round or square barstock or tubing. Accordingly, at least one portion of the frame members, and in particular the two long-side frame members which form the top and bottom frame portions, are normally manufactured from a steel sheet according to the present invention.

The four frame members are normally joined by welding to assemble the mask frame. The assembled mask frame is next heated in a hot gas furnace and blackening treatment is performed. The blackening treatment can be carried out in a conventional manner. The heating conditions are normally 450–680° C. for 10–30 minutes. Preferably the blackening treatment temperature is 500–650° C.

When the first heat treatment which is performed on the steel sheet is this blackening treatment, as explained with respect to the steel composition and the metal structure of the steel sheet of the present invention, during the blackening treatment, fine carbon-nitrides and the like such as $Mo_2C$ and VN precipitate, and the room temperature and high-temperature strength of the steel sheet (including the high-temperature creep properties) improve. As a result, the deformation of the mask frame is minimized when it subsequently undergoes stress relief annealing under a bending stress, and the tension in the shadow mask can be maintained. In addition, by the blackening treatment, a steel sheet according to the present invention can form a black film having good adhesion to the frame surface.

A tension-type shadow mask is attached to the mask frame which has undergone blackening treatment. As already described, attachment of the shadow mask is carried out by welding the upper and lower edges of the shadow mask to the upper and lower frame portions of the mask frame in a state in which an inwardly directed pressure is applied to the upper and lower frame portions of the mask frame. If necessary, a tensile force is applied in the vertical direction to the shadow mask. After completion of welding, the force applied to the frame or to the frame and the mask is released. As a result, a shadow mask/frame structure is obtained in which the shadow mask is supported by the mask frame under tension.

Finally, the shadow mask/frame structure is subjected to stress relief annealing. The stress relief annealing can be carried out in a temperature range of 400–680° C. and preferably 450–650° C. The heating time is normally 10–30 minutes. In this invention, the high-temperature strength (both the yield strength and the creep strength) of the mask frame which has undergone heat treatment is high, and deformation of the frame during stress relief annealing is suppressed.

Accordingly, tension in the shadow mask is maintained even after stress relief annealing, and the occurrence of defects such as color impurity caused by wrinkles or deviation of the pitch of holes in the shadow mask can be prevented.

This shadow mask/frame structure is disposed immediately in front of the fluorescent screen of a color CRT. There are no particular restrictions on the structure of the color CRT other than that of the shadow mask/frame structure, and it can be made a desired known structure or one developed hereafter.

The following examples are provided to illustrate the present invention, and they do not limit the present invention.

EXAMPLES

The steel slabs having the steel compositions shown in Table 1 were prepared, the slabs were subjected to hot rolling under the hot rolling conditions (finishing temperature and coiling temperature) shown in Table 2, and hot rolled steel sheets having a thickness of 4.50–5.00 mm were obtained. Some of the hot rolled steel sheets were subjected to skin pass rolling or cold rolling with the reduction shown in Table 2. After the completion of rolling, the steel sheets obtained by hot rolling or by hot rolling plus cold rolling were subject to pickling.

Some specimens of each steel sheet which was obtained were subjected to blackening treatment by heating in a hot gas furnace at 570° C. for 30 minutes.

The below-described properties of the steel sheets were investigated. The test results are also shown in Table 2.

(1) Tensile Properties

A No. 5 tensile test piece in accordance with JIS Z2201 was taken in the rolling direction from steel sheet which had not been subjected to blackening treatment (referred to as "as-rolled" steel sheet) and from steel sheet which had been subjected to blackening treatment, and a tensile test was carried out at room temperature in accordance with JIS Z2241.

A high-temperature tensile test at 460° C. corresponding to a stress relief annealing temperature was carried out in accordance with JIS 0567 for steel sheet which had been subjected to blackening treatment.

Table 2 shows the tensile properties of (0.2% yield stress YS, tensile stress TS, total elongation El) for the as-rolled steel sheet and the 0.2% yield stress YS at a high temperature of 460° C. for the steel sheet which had been subjected to blackening treatment.

(2) Metal structure: After a test piece of the as-rolled steel sheet was etched with nital etching reagent, observation with an SEM at a magnification of 2000 times was carried out, and the grain size and volume ratio of ferrite were determined. The ferrite volume ratio was determined by finding the ratio of area of ferrite in a plurality of SEM observations and taking the average thereof.

(3) Creep test: The high-temperature creep of a test piece taken from a steel sheet which had been subjected to blackening treatment was measured using an extensometer with a gauge length of 30 mm. The measured value was the elongation of a test piece which was maintained under a tensile stress of 294 N/mm$^2$ at 460° C. for one hour. As described above, a temperature of 460° C. corresponds to a stress relief annealing temperature.

Based on the measured creep, the high-temperature creep properties were evaluated according to the three levels o: at most 0.10%, Δ: greater than 0.10% and less than 0.15%, X: at least 0.15%. o means good, Δ means passable, and X means unsatisfactory.

(4) Surface quality: The surface of a steel sheet after pickling was visually observed, and the surface quality was evaluated based on whether there was severe scale damage (scale remains, scale indentation). o means there was no severe scale damage, and X means there was severe scale damage.

(5) Formability: Right angle bending was performed using a test piece of an as-rolled steel sheet, and formability was evaluated by visual observation of whether there were cracks in the outer surface of the bend. o means there were no obvious cracks in the outer surface of the bend and X means there were obvious cracks in the outer surface of the bend.

(6) Weldability: Two test pieces of the same as-rolled steel sheets were welded by TIG welding, and the welded portion was bent in the same manner as for formability. Weldability was evaluated based on whether there were large cracks in the welded portion. o means there were no large cracks in the welded portion, and X means there were large cracks in the welded portion.

(7) Adhesion of black film: The same bending as in the formability test was performed on a test piece of a steel sheet which had been subjected to blackening treatment. A film peeling test using transparent adhesive tape was carried out in the bent portion, and adhesion of the black film was evaluated based on the state of peeling of the film. o means there was no peeling or almost no peeling of the black film, and X means that clear traces of peeling were ascertained.

TABLE 1

| Run | Steel Composition (mass %) | | | | | | | | | | | | | | | | | Com- |
|---|---|---|---|---|---|---|---|---|---|---|---|---|---|---|---|---|---|---|
| No. | C | Si | Mn | P | S | Mo | V | N | Al | Cu | Ni | Cr | W | B | Ti | Nb | Al/N | ments |
| 1 | 0.15 | 0.16 | 0.67 | 0.017 | 0.006 | 0.35 | 0.12 | 0.0068 | 0.035 | — | — | — | — | — | — | — | 5.15 | Pre- |
| 2 | 0.15 | 0.16 | 0.67 | 0.017 | 0.006 | 0.35 | 0.11 | 0.0061 | 0.032 | — | — | 0.92 | — | — | — | — | 5.25 | sent |
| 3 | 0.15 | 0.16 | 0.67 | 0.017 | 0.006 | 0.35 | 0.11 | 0.0061 | 0.032 | — | — | 0.92 | — | — | — | — | 5.25 | In- |
| 4 | 0.15 | 0.16 | 0.67 | 0.017 | 0.006 | 0.35 | 0.11 | 0.0061 | 0.032 | — | — | 0.92 | — | — | — | — | 5.25 | ven- |
| 5 | 0.15 | 0.16 | 0.66 | 0.017 | 0.006 | 0.03 | 0.02 | 0.0058 | 0.032 | — | — | 0.92 | — | — | — | — | 5.52 | tion |
| 6 | 0.15 | 0.16 | 0.67 | 0.017 | 0.006 | 0.35 | 0.11 | 0.0061 | 0.032 | — | — | 0.92 | — | — | — | — | 5.25 | |
| 7 | 0.15 | 0.17 | 0.70 | 0.015 | 0.007 | 0.36 | 0.10 | 0.0065 | 0.035 | 0.50 | 0.30 | 0.93 | — | — | — | — | 5.38 | |
| 8 | 0.16 | 0.17 | 0.69 | 0.015 | 0.007 | 0.35 | 0.11 | 0.0063 | 0.032 | — | 0.50 | 0.82 | — | — | — | — | 5.08 | |
| 9 | 0.15 | 0.15 | 0.68 | 0.018 | 0.005 | 0.36 | 0.10 | 0.0066 | 0.039 | — | — | 0.95 | — | 0.0020 | — | — | 5.91 | |
| 10 | 0.05 | 0.20 | 0.75 | 0.020 | 0.006 | 0.35 | 0.12 | 0.0065 | 0.040 | — | — | 1.01 | — | — | — | — | 6.15 | |
| 11 | 0.15 | 0.16 | 0.67 | 0.016 | 0.008 | 0.35 | 0.10 | 0.0051 | 0.030 | — | — | 0.93 | 0.1 | — | — | — | 5.88 | |
| 12 | 0.15 | 0.20 | 0.72 | 0.021 | 0.006 | 0.36 | 0.08 | 0.0067 | 0.045 | — | — | 1.00 | — | — | — | — | 6.72 | |
| 13 | 0.15 | 0.19 | 0.73 | 0.021 | 0.006 | 0.02 | 0.04 | 0.0056 | 0.029 | — | — | 1.00 | — | — | — | — | 5.18 | |
| 14 | 0.15 | 0.19 | 0.72 | 0.021 | 0.006 | 0.02 | 0.08 | 0.0047 | 0.032 | — | — | 1.02 | — | — | — | — | 6.81 | |
| 15 | 0.15 | 0.19 | 0.72 | 0.020 | 0.006 | 0.02 | 0.12 | 0.0053 | 0.033 | — | — | 1.01 | — | — | — | — | 6.23 | |
| 16 | 0.15 | 0.19 | 0.73 | 0.021 | 0.006 | 0.02 | 0.02 | 0.0049 | 0.029 | — | — | 1.02 | — | — | — | — | 5.92 | |
| 17 | 0.15 | 0.19 | 0.73 | 0.021 | 0.006 | 0.02 | 0.02 | 0.0135 | 0.029 | — | — | 1.01 | — | — | — | — | 2.15 | |
| 18 | 0.15 | 0.19 | 0.73 | 0.021 | 0.006 | 0.02 | 0.02 | 0.0200 | 0.029 | — | — | 1.01 | — | — | — | — | 1.16 | |
| 19 | 0.15 | 0.16 | 0.67 | 0.017 | 0.006 | 0.35 | 0.11 | 0.0061 | 0.032 | — | — | 0.92 | — | — | — | — | 5.25 | |
| 20 | 0.15 | 0.16 | 0.67 | 0.017 | 0.006 | 0.35 | 0.11 | 0.0061 | 0.032 | — | — | 0.92 | — | — | — | — | 5.25 | |
| 21 | 0.15 | 0.16 | 0.67 | 0.017 | 0.006 | 0.35 | 0.11 | 0.0061 | 0.032 | — | — | 0.92 | — | — | — | — | 5.25 | |
| 22 | 0.07 | 0.19 | 1.38 | 0.015 | 0.001 | —* | 0.05 | 0.0050 | 0.040 | — | — | 0.05 | — | — | 0.04* | 0.038* | 8.00* | Com- |
| 23 | 0.16 | 0.19 | 0.70 | 0.020 | 0.010 | 0.18 | — | 0.0025* | 0.045 | — | — | 0.96 | — | — | — | — | 18.0* | para- |

TABLE 1-continued

| Run | Steel Composition (mass %) | | | | | | | | | | | | | | | | | Com- |
|---|---|---|---|---|---|---|---|---|---|---|---|---|---|---|---|---|---|---|
| No. | C | Si | Mn | P | S | Mo | V | N | Al | Cu | Ni | Cr | W | B | Ti | Nb | Al/N | ments |
| 24 | 0.16 | 0.16 | 0.72 | 0.015 | 0.003 | 0.34 | 0.09 | 0.0058 | 0.051 | — | — | 0.99 | — | — | 0.04* | 0.037* | 8.79* | tive |
| 25 | 0.17 | 0.21 | 0.75 | 0.019 | 0.007 | 0.34 | 0.01* | 0.0065 | 0.050 | — | — | 0.99 | — | — | — | — | 7.69* | |
| 26 | 0.15 | 0.17 | 0.79 | 0.019 | 0.009 | 0.01* | 0.09 | 0.0055 | 0.030 | — | — | 0.97 | — | — | — | — | 5.45 | |
| 27 | 0.16 | 0.19 | 0.72 | 0.018 | 0.007 | 0.01* | 0.01* | 0.0043 | 0.031 | — | — | 0.99 | — | — | — | — | 7.21* | Com- |
| 28 | 0.01* | 0.20 | 0.75 | 0.020 | 0.006 | 0.35 | 0.12 | 0.0059 | 0.053 | — | — | 1.01 | — | — | — | — | 8.98* | para- |
| 29 | 0.15 | 0.19 | 0.73 | 0.021 | 0.006 | —* | 0.01* | 0.0049 | 0.062 | — | — | 1.02 | — | — | — | — | 12.6* | tive |
| 30 | 0.15 | 0.20 | 0.72 | 0.021 | 0.006 | —* | 0.08 | 0.0049 | 0.031 | — | — | 0.01* | — | — | — | — | 6.33 | |
| 31 | 0.05 | 0.22 | 0.65 | 0.011 | 0.008 | —* | —* | 0.0090 | 0.018 | 0.05 | 0.05 | 5.15* | — | — | — | — | 2.00 | |
| 32 | 0.15 | 0.16 | 0.67 | 0.017 | 0.006 | 0.36 | 0.11 | 0.0061 | 0.032 | — | — | 0.92 | — | — | — | — | 5.25 | |
| 33 | 0.15 | 0.16 | 0.67 | 0.017 | 0.006 | 0.35 | 0.11 | 0.0061 | 0.032 | — | — | 0.92 | — | — | — | — | 5.25 | |
| 34 | 0.32* | 0.15 | 0.68 | 0.055 | 0.006 | 0.35 | 0.12 | 0.0048 | 0.035 | — | — | 0.05 | — | — | — | — | 7.29* | |
| 35 | 0.16 | 0.33* | 0.67 | 0.017 | 0.007 | 0.34 | 0.11 | 0.0068 | 0.031 | — | — | 0.05 | — | — | — | — | 4.56 | |
| 36 | 0.15 | 0.18 | 0.02* | 0.015 | 0.008 | 0.36 | 0.11 | 0.0072 | 0.045 | — | — | 0.05 | — | — | — | — | 6.25 | |
| 37 | 0.15 | 0.19 | 1.58* | 0.017 | 0.006 | 0.34 | 0.12 | 0.0068 | 0.048 | — | — | 0.05 | — | — | — | — | 7.06* | |
| 38 | 0.15 | 0.16 | 0.68 | 0.055* | 0.007 | 0.35 | 0.11 | 0.0082 | 0.031 | — | — | 0.05 | — | — | — | — | 3.78 | |
| 39 | 0.15 | 0.15 | 0.70 | 0.018 | 0.029* | 0.36 | 0.12 | 0.0075 | 0.035 | — | — | 0.06 | — | — | — | — | 4.67 | |
| 40 | 0.15 | 0.16 | 0.71 | 0.021 | 0.006 | 0.35 | 0.11 | 0.0066 | 0.039 | 1.05* | — | 0.05 | — | — | — | — | 5.91 | |
| 41 | 0.15 | 0.16 | 0.70 | 0.019 | 0.007 | 0.34 | 0.12 | 0.0073 | 0.031 | — | 1.08* | 0.05 | — | — | — | — | 4.25 | |
| 42 | 0.15 | 0.19 | 0.70 | 0.018 | 0.007 | 0.35 | 0.11 | 0.0061 | 0.038 | — | — | 2.12* | — | — | — | — | 6.23 | |
| 43 | 0.15 | 0.16 | 0.74 | 0.018 | 0.006 | 0.01* | 0.12 | 0.0083 | 0.035 | — | — | 0.05 | — | — | — | — | 4.22 | |
| 44 | 0.15 | 0.17 | 0.70 | 0.017 | 0.006 | 0.55* | 0.11 | 0.0058 | 0.030 | — | — | 0.05 | — | — | — | — | 5.17 | |
| 45 | 0.15 | 0.16 | 0.69 | 0.018 | 0.006 | 0.36 | 0.12 | 0.0067 | 0.035 | — | — | 0.05 | 1.1* | — | — | — | 5.22 | |
| 46 | 0.15 | 0.17 | 0.68 | 0.016 | 0.008 | 0.35 | 0.11 | 0.0075 | 0.110* | — | — | 0.05 | — | — | — | — | 14.6* | |
| 47 | 0.15 | 0.19 | 0.70 | 0.020 | 0.006 | 0.34 | 0.12 | 0.0085 | 0.039 | — | — | 0.05 | — | 0.0032* | — | — | 4.59 | |
| 48 | 0.15 | 0.16 | 0.66 | 0.021 | 0.007 | 0.35 | 0.22* | 0.0077 | 0.034 | — | — | 0.06 | — | — | — | — | 4.42 | |
| 49 | 0.15 | 0.19 | 0.70 | 0.018 | 0.006 | 0.35 | —* | 0.0028* | 0.038 | — | — | 0.05 | — | — | — | — | 13.5* | |
| 50 | 0.15 | 0.16 | 0.67 | 0.021 | 0.007 | 0.36 | —* | 0.0210* | 0.035 | — | — | 0.05 | — | — | — | — | 1.67 | |
| 51 | 0.15 | 0.01 | 0.43 | 0.010 | 0.007 | 0.36 | 0.08 | 0.0025* | 0.039 | — | — | 0.02 | — | — | — | — | 15.6* | |

*outside of the range of the present invention

TABLE 2

| | Manufacturing Conditions | | | | As-Rolled Properties | | | | |
|---|---|---|---|---|---|---|---|---|---|
| | Hot Rolling Conditions | | Cold | | Material Structure: Ferrite Condition | | Tensile Properties[1)] | | |
| Run | Finishing Temp | Coiling Temp. | Rolling Reduction | Sheet Thickness | Volume Ratio | Grain Size | YS, TS: N/mm$^2$ EI: % | | |
| No. | (° C.) | (° C.) | (%) | (mm) | (%) | (μm) | YS | TS | EI |
| 1 | 860 | 500 | 0 | 4.5 | 47 | 4.1 | 620 | 740 | 21.5 |
| 2 | 860 | 500 | 0 | 4.5 | 40 | 3.8 | 630 | 805 | 18.2 |
| 3 | 860 | 580 | 0 | 4.5 | 49 | 4.4 | 612 | 738 | 20.6 |
| 4 | 860 | 650 | 0 | 4.5 | 70 | 9.7 | 588 | 690 | 21.5 |
| 5 | 820 | 400 | 0 | 4.5 | 18 | 1.9 | 699 | 717 | 15.8 |
| 6 | 950 | 650 | 0 | 4.5 | 88 | 13.8 | 570 | 690 | 20.8 |
| 7 | 860 | 580 | 0 | 4.5 | 48 | 4.1 | 618 | 801 | 17.5 |
| 8 | 860 | 580 | 0 | 4.5 | 48 | 4.8 | 603 | 757 | 19.1 |
| 9 | 860 | 580 | 0 | 4.5 | 45 | 5.6 | 593 | 739 | 19.4 |
| 10 | 860 | 580 | 0 | 4.5 | 85 | 14.0 | 579 | 690 | 22.1 |
| 11 | 860 | 580 | 0 | 4.5 | 51 | 4.5 | 610 | 735 | 19.1 |
| 12 | 860 | 580 | 0 | 4.5 | 50 | 4.3 | 615 | 747 | 19.8 |
| 13 | 860 | 500 | 0 | 5.0 | 65 | 7.1 | 504 | 605 | 26.1 |
| 14 | 860 | 500 | 0 | 5.0 | 58 | 6.5 | 525 | 618 | 25.3 |
| 15 | 860 | 500 | 0 | 5.0 | 49 | 5.5 | 538 | 632 | 23.8 |
| 16 | 860 | 470 | 0 | 5.0 | 65 | 6.7 | 536 | 595 | 26.1 |
| 17 | 860 | 470 | 0 | 5.0 | 63 | 6.0 | 552 | 618 | 25.3 |
| 18 | 860 | 470 | 0 | 5.0 | 61 | 5.4 | 589 | 650 | 23.1 |
| 19 | 860 | 580 | 0.3 | 4.5 | 49 | 4.4 | 659 | 787 | 17.0 |
| 20 | 860 | 580 | 2.0 | 4.5 | 49 | 4.4 | 665 | 790 | 16.8 |
| 21 | 860 | 580 | 7.0 | 4.5 | 49 | 4.4 | 692 | 815 | 11.8 |
| 22 | 800 | 550 | 0 | 4.6 | 85 | 9.5 | 515 | 641 | 27.2 |
| 23 | 860 | 500 | 0 | 4.6 | 60 | 5.9 | 513 | 648 | 25.4 |
| 24 | 860 | 580 | 0 | 4.6 | 75 | 8.5 | 598 | 743 | 21.5 |
| 25 | 860 | 580 | 0 | 4.6 | 78 | 15.2 | 558 | 732 | 20.6 |
| 26 | 860 | 580 | 0 | 4.6 | 85 | 16.1 | 515 | 626 | 23.5 |
| 27 | 860 | 580 | 0 | 4.6 | 90 | 18.2 | 522 | 604 | 24.1 |

TABLE 2-continued

| | | | | | | | | | |
|---|---|---|---|---|---|---|---|---|---|
| 28 | 860 | 580 | 0 | 4.6 | 95 | 25.1 | 502 | 662 | 24.3 |
| 29 | 860 | 580 | 0 | 4.6 | 91 | 8.5 | 500 | 595 | 25.8 |
| 30 | 860 | 580 | 0 | 4.6 | 86 | 15.8 | 435 | 542 | 27.2 |
| 31 | 820 | 630 | 0 | 4.6 | 88 | 4.3 | 794 | 949 | 17.3 |
| 32 | 810 | 580 | 0 | 4.6 | 91 | 18.3 | 520 | 620 | 18.9 |
| 33 | 860 | 710 | 0 | 4.5 | 91 | 14.9 | 558 | 667 | 21.9 |
| 34 | 860 | 580 | 0 | 4.6 | 39 | 5.7 | 621 | 793 | 17.0 |
| 35 | 860 | 580 | 0 | 4.6 | 51 | 4.5 | 580 | 705 | 18.3 |
| 36 | 860 | 580 | 0 | 4.6 | 77 | 15.1 | 537 | 628 | 24.1 |
| 37 | 860 | 580 | 0 | 4.6 | 31 | 2.8 | 616 | 747 | 20.5 |
| 38 | 860 | 580 | 0 | 4.6 | 48 | 5.1 | 560 | 680 | 22.7 |
| 39 | 860 | 580 | 0 | 4.6 | 49 | 4.3 | 565 | 680 | 22.3 |
| 40 | 860 | 580 | 0 | 4.6 | 48 | 3.9 | 723 | 823 | 17.1 |
| 41 | 860 | 580 | 0 | 4.6 | 31 | 6.1 | 695 | 821 | 20.2 |
| 42 | 860 | 580 | 0 | 4.6 | 43 | 4.0 | 705 | 840 | 16.5 |
| 43 | 860 | 580 | 0 | 4.6 | 91 | 15.2 | 445 | 560 | 25.8 |
| 44 | 860 | 580 | 0 | 4.6 | 31 | 3.2 | 698 | 831 | 19.8 |
| 45 | 860 | 580 | 0 | 4.6 | 30 | 3.0 | 702 | 829 | 21.5 |
| 46 | 860 | 580 | 0 | 4.6 | 92 | 8.0 | 601 | 680 | 21.0 |
| 47 | 860 | 580 | 0 | 4.6 | 48 | 4.4 | 589 | 680 | 22.3 |
| 48 | 860 | 580 | 0 | 4.6 | 40 | 3.5 | 705 | 825 | 20.6 |
| 49 | 860 | 580 | 0 | 4.6 | 71 | 10.1 | 528 | 638 | 23.9 |
| 50 | 860 | 580 | 0 | 4.6 | 51 | 4.3 | 551 | 638 | 21.9 |
| 51 | 860 | 580 | 0 | 4.6 | 66 | 12.5 | 433 | 546 | 29.1 |

| | Properties after Blackening Treatment at 570° C. × 30 minites | | | Other Properties | | | | | |
|---|---|---|---|---|---|---|---|---|---|
| | Room Temp. and High Temp. YS: N/mm$^2$ | | High Temp. | | | | Adhesion of | High Temp. Creep | |
| Run No. | Room Temp | 460° C. | Creep (%) | Surface Quality | Formability | Weldability | Black Film | Properties | Comments |
| 1 | 632 | 398 | 0.07 | ○ | ○ | ○ | ○ | ○ | Present Invention |
| 2 | 778 | 515 | 0.02 | ○ | ○ | ○ | ○ | ○ | |
| 3 | 646 | 423 | 0.04 | ○ | ○ | ○ | ○ | ○ | |
| 4 | 619 | 406 | 0.06 | ○ | ○ | ○ | ○ | ○ | |
| 5 | 706 | 410 | 0.07 | ○ | ○ | ○ | ○ | ○ | |
| 6 | 597 | 335 | 0.09 | ○ | ○ | ○ | ○ | ○ | |
| 7 | 651 | 465 | 0.03 | ○ | ○ | ○ | ○ | ○ | |
| 8 | 629 | 423 | 0.04 | ○ | ○ | ○ | ○ | ○ | |
| 9 | 606 | 430 | 0.05 | ○ | ○ | ○ | ○ | ○ | |
| 10 | 580 | 325 | 0.09 | ○ | ○ | ○ | ○ | ○ | |
| 11 | 648 | 523 | 0.02 | ○ | ○ | ○ | ○ | ○ | |
| 12 | 641 | 411 | 0.04 | ○ | ○ | ○ | ○ | ○ | |
| 13 | 529 | 315 | 0.09 | ○ | ○ | ○ | ○ | ○ | |
| 14 | 555 | 344 | 0.08 | ○ | ○ | ○ | ○ | ○ | |
| 15 | 571 | 362 | 0.08 | ○ | ○ | ○ | ○ | ○ | |
| 16 | 541 | 315 | 0.09 | ○ | ○ | ○ | ○ | ○ | |
| 17 | 575 | 329 | 0.09 | ○ | ○ | ○ | ○ | ○ | |
| 18 | 622 | 353 | 0.08 | ○ | ○ | ○ | ○ | ○ | |
| 19 | 860 | 480 | 0.04 | ○ | ○ | ○ | ○ | ○ | |
| 20 | 865 | 490 | 0.03 | ○ | ○ | ○ | ○ | ○ | |
| 21 | 899 | 551 | 0.01 | ○ | ○ | ○ | ○ | ○ | |
| 22 | 593 | 288 | >0.2 | ○ | ○ | X | ○ | X | Comparative |
| 23 | 520 | 371 | 0.12 | ○ | ○ | ○ | ○ | Δ | |
| 24 | 601 | 298 | >0.2 | ○ | ○ | ○ | ○ | X | |
| 25 | 555 | 288 | >0.2 | ○ | ○ | ○ | ○ | X | |
| 26 | 511 | 283 | >0.2 | ○ | ○ | ○ | ○ | X | |
| 27 | 510 | 272 | >0.2 | ○ | ○ | ○ | ○ | X | Comparative |
| 28 | 498 | 256 | >0.2 | ○ | ○ | ○ | ○ | X | |
| 29 | 488 | 251 | >0.2 | ○ | ○ | ○ | X | X | |
| 30 | 415 | 212 | >0.2 | ○ | ○ | ○ | ○ | X | |
| 31 | 631 | 398 | 0.05 | ○ | X | X | ○ | ○ | |
| 32 | 536 | 322 | >0.2 | ○ | ○ | ○ | ○ | X | |
| 33 | 583 | 335 | >0.2 | ○ | ○ | ○ | ○ | X | |
| 34 | 717 | 443 | 0.03 | ○ | X | X | ○ | ○ | |
| 35 | 609 | 377 | 0.04 | X | ○ | X | X | ○ | |
| 36 | 535 | 310 | >0.2 | X | ○ | X | ○ | X | |
| 37 | 678 | 419 | 0.08 | ○ | ○ | X | ○ | ○ | |
| 38 | 588 | 364 | 0.04 | X | X | X | ○ | ○ | |
| 39 | 591 | 367 | 0.09 | X | X | X | ○ | ○ | |
| 40 | 737 | 456 | 0.04 | X | X | ○ | ○ | ○ | |
| 41 | 643 | 398 | 0.06 | ○ | X | ○ | ○ | ○ | |
| 42 | 814 | 504 | 0.02 | ○ | X | X | ○ | ○ | |

TABLE 2-continued

| | | | | | | | | |
|---|---|---|---|---|---|---|---|---|
| 43 | 425 | 265 | >0.2 | ○ | ○ | ○ | ○ | X |
| 44 | 722 | 448 | 0.04 | ○ | X | ○ | ○ | ○ |
| 45 | 662 | 410 | 0.03 | ○ | X | ○ | ○ | ○ |
| 46 | 568 | 351 | 0.19 | X | ○ | X | ○ | X |
| 47 | 570 | 325 | >0.2 | ○ | ○ | X | ○ | X |
| 48 | 664 | 411 | 0.03 | ○ | X | X | ○ | ○ |
| 49 | 488 | 302 | >0.2 | ○ | ○ | ○ | ○ | X |
| 50 | 607 | 376 | 0.07 | X | ○ | ○ | ○ | ○ |
| 51 | 513 | 318 | 0.12 | ○ | ○ | ○ | ○ | Δ |

[1)]YS: 0.2% Yeald Stress,
TS: Tensile Strength,
El: Total Elongation

As can be seen from Table 2, a steel sheet having a steel composition and metal structure according to the present invention had good tensile properties in an as-rolled state, and formability, weldability, and the surface condition after pickling were also good. In addition, it had an improved yield stress at room temperature after undergoing heat treatment in the form of blackening treatment, and it had good high-temperature strength at a stress relief annealing temperature. Therefore, the creep at high temperature was a low value of at most 0.10%, and the high-temperature creep properties were excellent. Furthermore, a black film having good adhesion could be formed by blackening treatment. Therefore, it is clear that according to the present invention, a steel sheet which has all of the various properties required of a mask frame for a tension-type shadow mask and which is relatively inexpensive is provided.

Comparative steel sheets which had a steel composition and/or a metal structure which was outside the range of the present invention had at least one property which was inadequate. In particular, as in Nos. 31, 42, 44, and 45, a steel sheet to which a large amount of Cr, Mo, or W was added had properties inferior to those of the steel sheet of the present invention in spite of being expensive.

Figure 2:
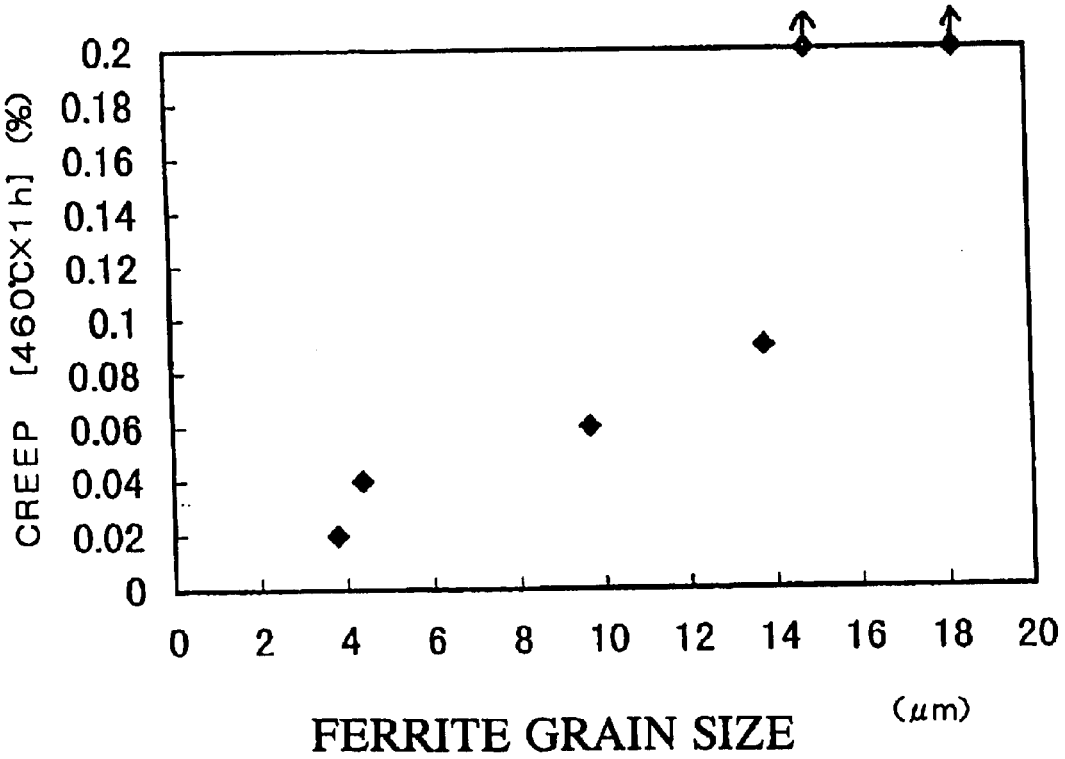
Figure 3:
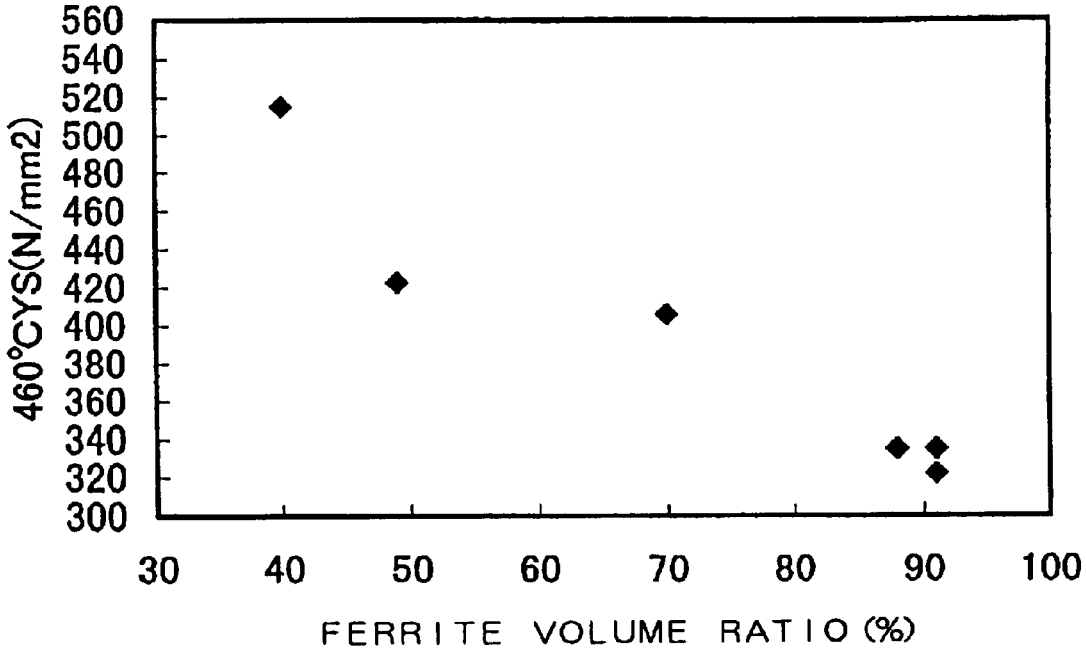
Figure 4:
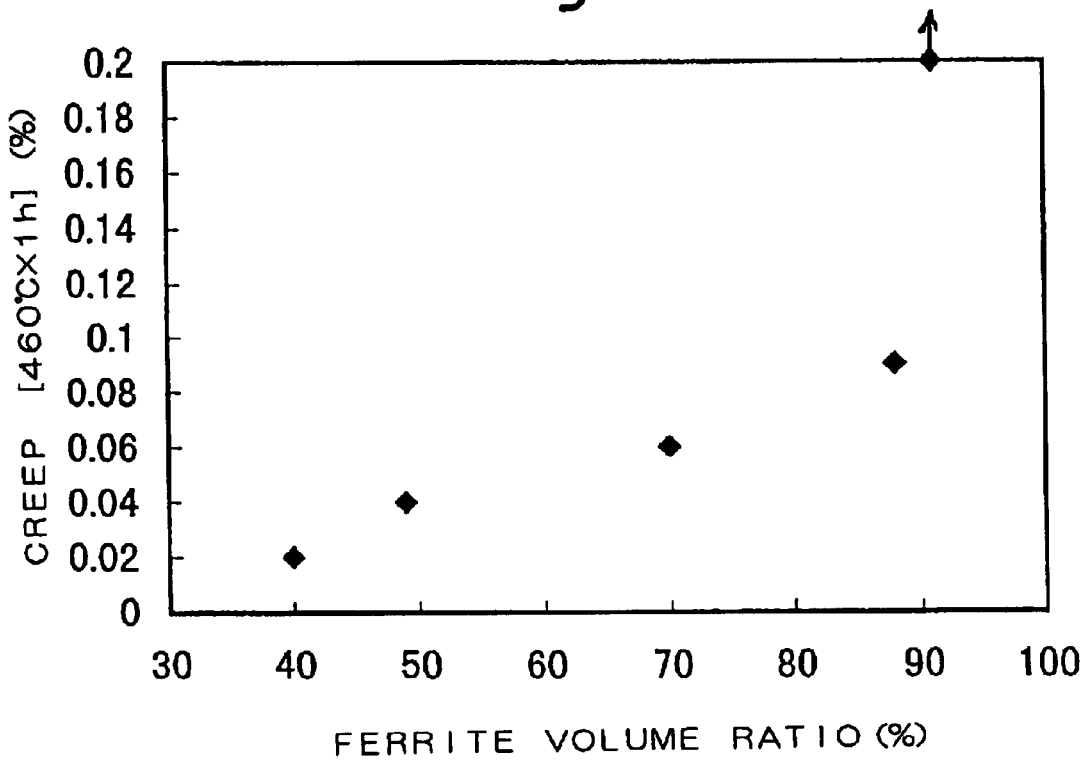

The relationships of the yield stress at 460° C. and the creep (460° C. for 1 hour) to the ferrite grain size and the ferrite volume ratio for Nos. 2–4, 6, 32, and 33 of Table 2 are shown in FIG. 1–FIG. 4 as graphs. From these figures, the criticality of a ferrite grain size of at most 15 micrometers and a ferrite volume ratio of at most 90% according to the present invention is clear.

Industrial Applicability

According to the present invention, a relatively inexpensive steel sheet having the various properties (surface quality, formability, weldability, room temperature and high-temperature strength, low creep at a high temperature, adhesion of a black film) required of a mask frame for maintaining a tension-type color CRT shadow mask under tension is provided.

The present invention is technology which contributes to a low cost and a decrease in weight of color CRT's having a tension-type shadow mask such as those for televisions. A steel sheet of the present invention can be used not only in the above-described type in which tension acts only in the vertical direction, but it can also be used in a mask frame for a tension-type shadow mask in which it is applied in the two directions of the vertical direction and the horizontal direction. In addition, a steel sheet according to the present invention can be used in a mask frame for supporting a conventional shadow mask which is not of the tension type.

What is claimed is:

1. A rectangular mask frame for a color CRT formed by joining four frame members, at least one of the frame members being formed from a steel sheet having a steel composition consisting essentially of, in mass %, C: 0.03–0.30%, Si: at most 0.30%, Mn: 0.05–1.5%, P: at most 0.05%, S: at most 0.02%, Mo: 0.02–0.50%, V: 0.02–0.20%, Al: at most 0.10%, N: 0.0040–0.0200%, Cu: 0–1.0%, Ni: 0–1.0%, Cr: 0–2.0%, W: 0–1.0%, B: 0–0.003%, Ti: 0–0.030%, Nb: 0–0.030%, and a balance of iron and unavoidable impurities, with Al≦(7.0)N, and having a metal structure in which the ferrite grain size is at most 15 micrometers and the ferrite volume ratio is at most 90%.

2. A color CRT mask frame as described in claim 1 wherein the steel composition does not include Cu, Ni, Cr, W, B, Ti, or Nb.

3. A color CRT mask frame as described in claim 1 wherein the steel composition contains one or two or more of Cu: at most 1.0%, Ni: at most 1.0%, Cr: at most 2.0%, W: at most 1.0%, B: at most 0.003%, Ti: at most 0.030%, and Nb: at most 0.030%.

4. A color CRT equipped with the mask frame of claim 1.

5. A color CRT mask frame manufactured by a method including the following steps:

a step of shaping a steel sheet to form a color CRT mask frame member, the steel sheet having a steel composition consisting essentially of, in mass %, C: 0.03–0.30%, Si: at most 0.30%, Mn: 0.05–1.5%, P: at most 0.05%, S: at most 0.02%, Mo: 0.02–0.50%, V: 0.02–0.20%, Al: at most 0.10%, N: 0.0040–0.0200%, cu: 0–1.0%, Ni: 0–1.0%, Cr: 0–2.0%, W: 0–1.0%, B: 0–0.003%, Ti: 0–0.030%, Nb: 0–0.030%, and a balance of iron and unavoidable impurities, with Al≦(7.0)N, and having a metal structure in which the ferrite grain size is at most 15 micrometers and the ferrite volume ratio is at most 90%, a step of joining four mask frame members, at least one of which are the above-described mask frame members, to form a color CRT mask frame, and a step of performing blackening treatment of the color CRT mask frame which was formed at a temperature in the range of 450–680° C. to form a black film on the frame surface.

6. A color CRT mask frame manufactured by a method including the following steps:

a step of shaping a steel sheet to form a color CRT mask frame member, the steel sheet having a steel composition consisting essentially of, in mass %, C: 0.03–0.30%, Si: at most 0.30%, Mn: 0.05–1.5%, P: at most 0.05%, S: at most 0.02%, Mo: 0.02–0.50%, V: 0.02–0.20%, Al: at most 0.10%, N: 0.0040–0.0200%, cu: 0–1.0%, Ni: 0–1.0%, Cr: 0–2.0%, W: 0–1.0%, B: 0–0.003%, Ti: 0–0.030%, Nb: 0–0.030%, and a balance of iron and unavoidable impurities, with Al≦(7.0)N, and having a metal structure in which the ferrite grain size is at most 15 micrometers and the ferrite volume ratio is at most 90%, a step of joining four mask frame members, at least one of which are the above-described mask frame members, to form a color CRT mask frame, and a step of performing stress relief annealing of the color CRT mask frame which was formed at a temperature in the range of 400–680° C.

7. A tension-type color CRT shadow mask/frame structure manufactured by a method including the following steps:

a step of securing a shadow mask so that tension is applied thereto to the color CRT mask frame of claim 5 to form a shadow mask/frame structure, and a step of performing stress relief annealing of the structure at a temperature in the range of 400–600° C.

8. A tension-type color CRT shadow mask/frame structure manufactured by a method including the following steps:

a step of securing a shadow mask so that tension is applied thereto to the color CRT mask frame of claim 6 to form a shadow mask/frame structure, and a step of performing blackening treatment of the structure at a temperature in the range of 450–680° C. to form a black film on the surface of the structure.

* * * * *

UNITED STATES PATENT AND TRADEMARK OFFICE

CERTIFICATE OF CORRECTION

PATENT NO. : 6,806,631 B2
DATED : October 19, 2004
INVENTOR(S) : Tatsuo Yoshii et al.

It is certified that error appears in the above-identified patent and that said Letters Patent is hereby corrected as shown below:

Column 18,
Line 48, change “cu” to -- Cu --

Column 15,
Line 5, change “cu” to -- Cu --

Column 20,
Line 7, change “600°C” to -- 680 °C

Signed and Sealed this

Nineteenth Day of April, 2005

JON W. DUDAS
*Director of the United States Patent and Trademark Office*